US006308649B1

(12) United States Patent
Gedeon

(10) Patent No.: US 6,308,649 B1
(45) Date of Patent: Oct. 30, 2001

(54) SAILBOAT AND CREW PERFORMANCE OPTIMIZATION SYSTEM

(76) Inventor: Steven A. Gedeon, 278 Bloor St., East, Suite 2304, Toronto Ontario (CA), M4W 3M4

( * ) Notice: Subject to any disclaimer, the term of this patent is extended or adjusted under 35 U.S.C. 154(b) by 0 days.

(21) Appl. No.: 09/482,142

(22) Filed: Jan. 12, 2000

Related U.S. Application Data

(60) Provisional application No. 60/115,550, filed on Jan. 12, 1999.

(51) Int. Cl.[7] ..... B63H 9/00
(52) U.S. Cl. ..... 114/39.11; 701/21
(58) Field of Search ..... 114/39.11, 102.1, 114/102.16–102.21, 102.22, 102.12; 701/21

(56) References Cited

U.S. PATENT DOCUMENTS

| | | | | |
|---|---|---|---|---|
| 3,654,807 | * | 4/1972 | Deskey | 114/102.1 |
| 3,763,703 | * | 10/1973 | Man | 114/102.6 |
| 3,800,128 | * | 3/1974 | Kurk | 235/151.32 |
| 3,814,910 | * | 6/1974 | Palmieri | 235/150.2 |
| 3,875,388 | * | 4/1975 | Luten et al. | 235/150.2 |
| 3,881,094 | * | 4/1975 | Taylor et al. | 235/150.2 |
| 3,881,095 | * | 4/1975 | Taylor et al. | 235/150.2 |
| 4,340,936 | * | 7/1982 | Mounce | 364/443 |
| 4,671,201 | * | 6/1987 | Yokoyama | 114/102.19 |
| 4,785,404 | * | 11/1988 | Sims et al. | 364/443 |
| 5,452,216 | * | 9/1995 | Mounce | 364/449 |

FOREIGN PATENT DOCUMENTS 2 171 208 A * 8/1986 (GB) .

* cited by examiner

*Primary Examiner*—Sherman Basinger
(74) *Attorney, Agent, or Firm*—James J. Leary; Carol D. Titus

(57) ABSTRACT

A sailboat and crew performance optimization system includes a modular system of sensors, data acquisition, computational analysis, graphical display and optional feedback control for optimizing sailboat and crew performance. The system acquires data relating to external factors (e.g. wind speed, wind direction, variations in wind speed, variations in wind direction, sea state, and wave conditions), performance parameters (e.g. boat speed, time to reach a specified destination and velocity made good, safety parameters and sailboat comfort parameters), dependent variable setpoints (e.g. sail shape, sail pressure distribution, etc.), and control variables (e.g. line tensions, rudder angle, sail plan, etc.) and correlates or analyzes the data to determine or predict the optimum setpoint targets and control variables. The system displays information and relationships to the sailboat crew in order to optimize sailboat performance and crew performance. The system also provides benchmark measures of sailboat performance and crew performance to compare performance at different times or under different conditions or to measure progress or improvement in performance. Optionally, the system can be used for automatic feedback control of sailboat operation. The system may utilize a computer or an artificial intelligence system, such as a neural network system, a fuzzy logic system, a genetic algorithm system or an expert system, to analyze and predict optimum setpoint targets and control variables.

23 Claims, 12 Drawing Sheets

FIGURE 6

GENOA TRIM CARD SAMPLE

| GENOA: *MEDIUM #1 (NORTH)* | LOW END | MIDRANGE | HIGH END |
|---|---|---|---|
| | | | |
| Wind Range (knots apparent) | *6-11* | *11-15* | *15-20* |
| Maximum Apparent Wind Speed (from sailmaker) | | | |
| Lead Angle (degrees) | *9°* | *9°* | *10°* |
| Lead Position (hole number) | *4* | *3* | *2* |
| Distance to Upper Spreader | *8″* | *6″* | *6″* |
| Distance to Chainplates | *4″* | *1″* | *touching* |
| Depth (% at midstripe) | *18%* | *17%* | *16%* |
| Draft Position (% at mid) | *48%* | *46%* | *45%* |
| Backstay Tension (% of max) | *60%* | *80%* | *MAX* |
| Halyard Tension | *6* | *3* | *Two-blocked* |

MAINSAIL TRIM CARD SAMPLE

| MAINSAIL: *NORTH k/M 88* | LIGHT AIR | MEDIUM | HEAVY AIR |
|---|---|---|---|
| | | | |
| Wind Range (knots apparent) | *0-12* | *12-20* | *20+* |
| Top Batton (angle to boom) | *parallel* | *parallel* | *slightly open* |
| Outhaul (inches from band) | *2″* | *MAX* | *MAX* |
| Cunningham | *none* | *little* | *hard* |
| Depth (% at midstripe) | *15%* | *13%* | *11%* |
| Draft Position (% at max) | *50%* | *50%* | *50%* |
| Backstay Tension (% of max) | *50%* | *75%* | *95%* |
| Boom Position | *centerline* | *centerline* | *traveler eased* |
| Battens | *soft top 2* | *soft top 1* | *stiff* |
| Rudder Angle (degrees) | *3°* | *4°* | *5°* |

MAINSAIL: TARGET DEPTHS AND DRAFT POSITIONS

| Apparent Wind (Knots) | Lower Stripe Depth | Lower Stripe Position | Middle Stripe Depth | Middle Stripe Position | Upper Stripe Depth | Upper Stripe Position |
|---|---|---|---|---|---|---|
| 3-6 | 14-15% | 45% | 15-16% | 45% | 16-17% | 45% |
| 5-12 | 12% | 50% | 14-15% | 50% | 15-16% | 50% |
| 10-18 | 10% | 50% | 12-13% | 50% | 13-14% | 50% |
| 16-26 | 8-9% | 50% | 11% | 50% | 11% | 50% |
| 24-30 | 9% | 50% | 10% | 50% | 10% | 50% |

A = Appropriate rudder control to maintain constant apparent wind direction (β - λ)
B = Poor rudder control
C = Slow to react to wind shift
D = Overshoot adjustment to wind shift
E = Total time to regain desired apparent wind direction (β - λ)
F = Good steady helm
G = Failure to recognize wind shift and slow to react

A = Time to complete tack (and regain former relative boat speed)
B = Time to complete tack using different tacking tactic
C = Overshoot heading and sheet out to increase speed and decrease tacking time

Figure 11

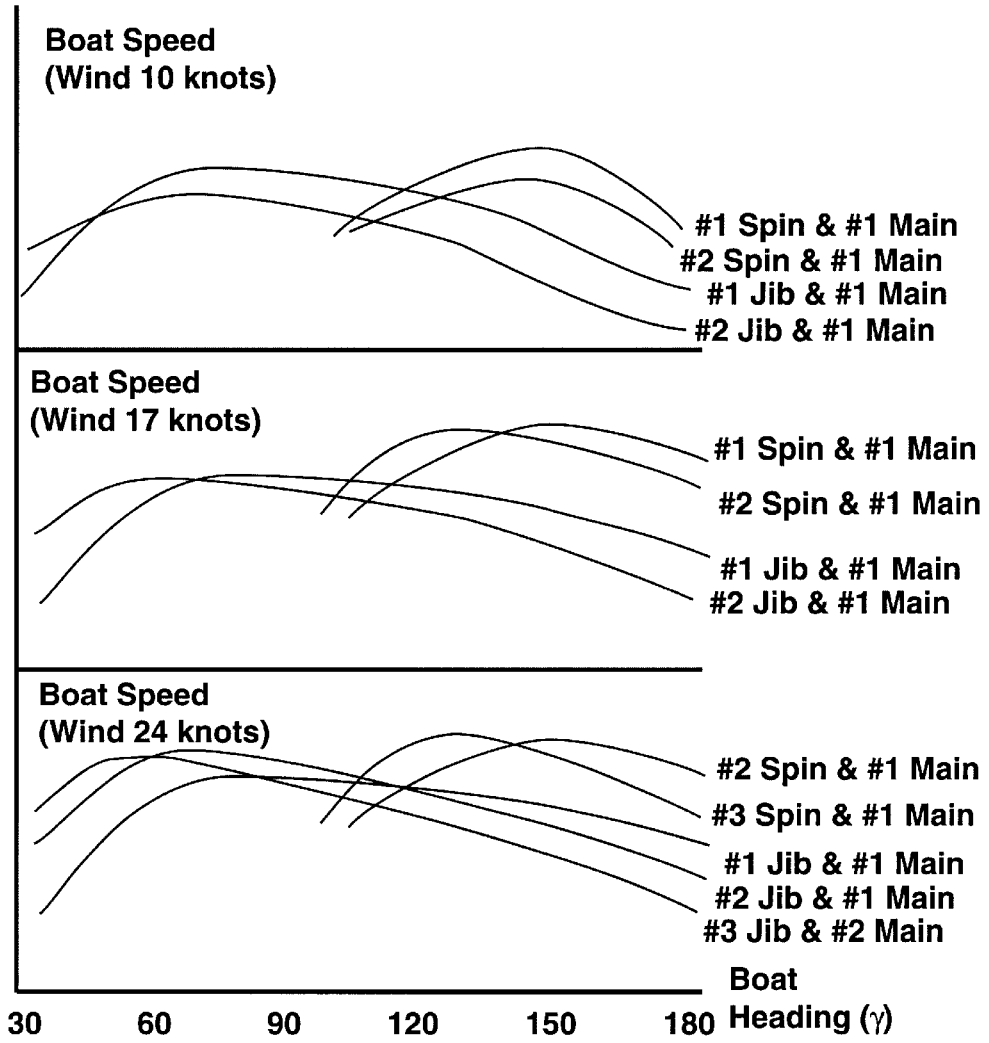

At 10 knots the #1 jib has a clear advantage over the #2 jib unless high pointing is critical. The #1 Spinnaker is clearly better than any other spinnaker.

At 17 knots the # 2 jib can now point higher and faster. The #1 Spinnaker still has an advantage when going more downwind.

At 24 knots the #3 jib and #2 main point highest, but the #2 jib and #1 main have a better overall advantage on other headings. The #2 spinnaker still has an advantage when going more downwind (the #1 spinnaker is too light to fly in these winds).

Figure 12

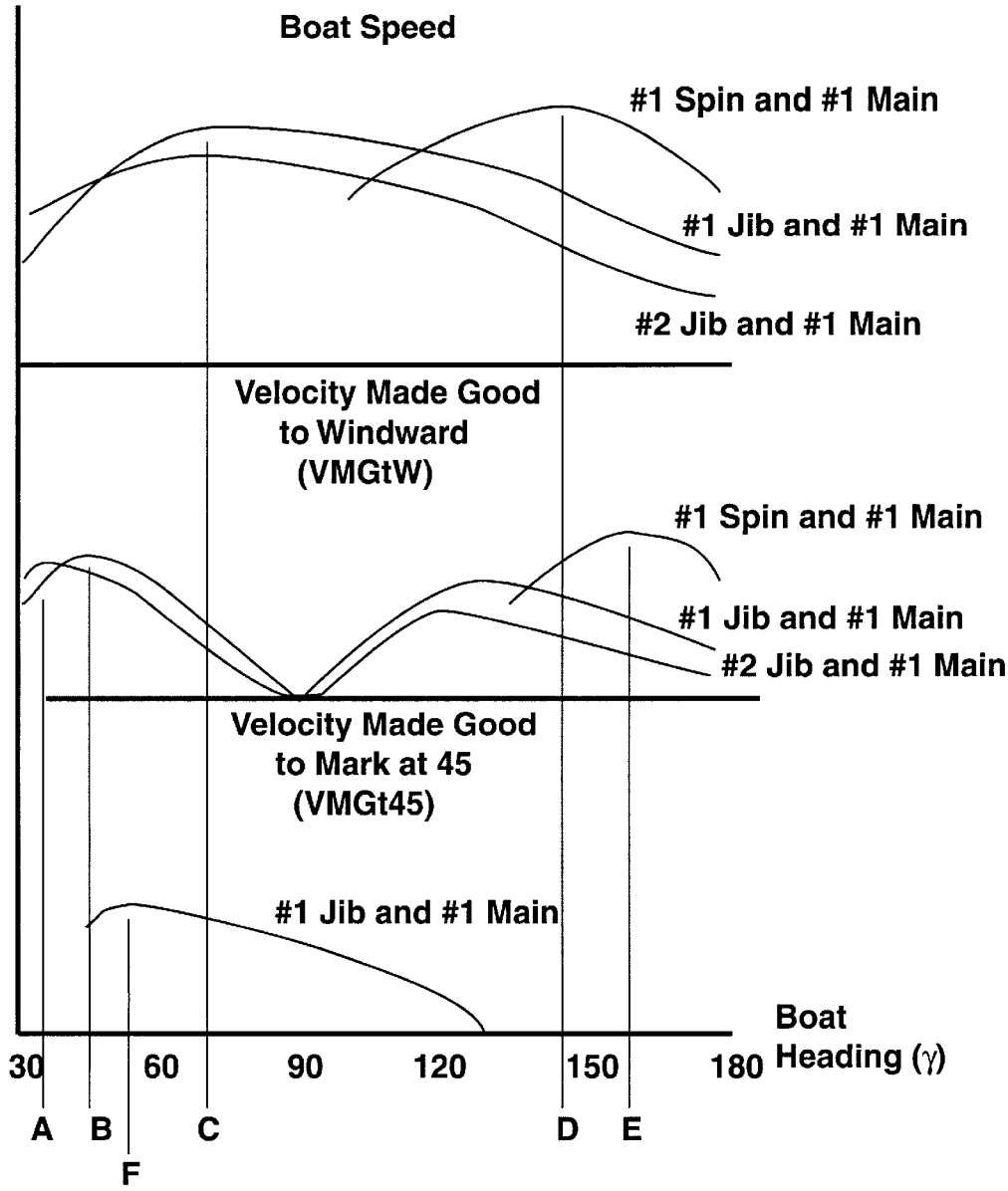

A = Heading for Maximum VMGtW for #2 Jib and #1 Main
B = Heading for Maximum VMGtW for #1 Jib and #1 Main
C = Heading for Maximum Boat Speed for #1 Jib and #1 Main
D = Heading for Maximum Boat Speed for #1 Spinnaker and #1 Main
E = Heading for Maximum VMGtW for #1 Spinnaker and #1 Main
F = Heading for Maximum VMGt45 for #1 Jib and #1 Main (note that the 45 layline to the mark at 45 does not give the best VMG, it is slightly faster to foot off.)

SAILBOAT AND CREW PERFORMANCE OPTIMIZATION SYSTEM

CROSS REFERENCE TO OTHER PATENT APPLICATIONS

This patent application claims the benefit of U.S. Provisional Patent Application, Ser. No. 60/115,550, filed Jan. 12, 1999, the specification of which is hereby incorporated in its entirety.

FIELD OF THE INVENTION

The present invention relates generally to the application of sensors to sailboats and recreational boating. Enhanced sailboat and crew performance is achieved through the use of new and existing sensors, data acquisition, computational analysis, graphical display and optional feedback control. The present invention covers the concept of a systems approach to measuring and optimizing sailboat and crew performance as well as the various sub-components, technology, software, algorithms and relationships that make up the implementation of such a system.

BACKGROUND OF THE INVENTION

The hydro-aerodynamic theory of sailing shows that optimizing sailboat performance is extremely complicated. There are also many complex inter-relationships between the many factors affecting sailboat performance. If we want to maximize boat speed (or other factor such as safety) External Factors such as wind speed, wind direction, variations in wind speed, variations in wind direction, and wave conditions will determine Optimum Setpoint Targets such as sail plan (size and type of sails used), sail shape, sail pressure distribution, boat heel, and rudder angle. In order to achieve these Optimum Setpoint Targets, various Control Variables such as forestay sag, mast bend, sheet tension, and halyard tension must be used. However, there is a complex inter-relationship between the Control Variables. For example both backstay tension and sheet tension will affect forestay sag which will affect the sail shape. Changes in mast bend will affect both jib and main sail shape.

In addition to the complex relationship between all of these variables, very small changes in a single variable may have an enormous effect on sailboat performance. For example, FIG. 2 (taken from page 329, Aero-Hydrodynamics of Sails by Marchaj) shows the effect of sail draft depth (or camber) on sail pressure, holding all other variables constant under carefully controlled laboratory conditions. As can be seen, an increase in draft depth from 16.3% to 18.6% causes an increase in maximum pressure coefficient from 1.6 to 2.0 (while also reducing negative pressure on the windward side). This seemingly insignificant change in draft depth, which cannot even be measured on board a racing sailboat, causes a 25% increase in sail pressure! Since sail pressure is the driving force that moves a boat through the water, it is obvious that precise measurement and control of the draft depth is critical to optimizing the boat's performance.

While such laboratory experiments demonstrate that precise measurements are critical to optimizing sailboat performance, the data cannot be used in isolation on an actual boat. Many other factors and relationships must also be considered.

For simplicity in illustration, we may isolate the effect of wind speed on optimum sail shape. Small variations in wind speed have a large effect on optimum sail shape (e.g. draft depth and location . . . ) for a given sail. Furthermore, small variations in sail shape have a large effect on sail pressure and thus boat speed. These small and subtle changes are extremely difficult for the sailor to measure much less optimize.

For example, in a 4 knot wind the optimum draft depth for a given sail may be 10% and the optimum draft position may be 48%. In 8 knots the optimum may be 16% and 46%. In 12 knots the optimum may be 14% and 44%. In 18 knots the optimum may be 10% and 44%. However, in practice, it may be impossible for a sailor to measure by eye such subtle differences in draft depth and position even though such differences significantly affect boat speed. Furthermore; since wind direction, boat heel, rudder position, and other factors are constantly changing, it may be impossible for the sailor to even determine what the optimum sail shape should be, much less to measure what it is.

Some complexity may be added to this simple illustration. The optimum draft depth and position will vary from the foot to the head of both the jib and main sails, thus the sail twist must also be optimized. Also, rather than optimizing boat speed, we may optimize the "Velocity Made Good—Vmg" also known as Way Made Good (going fast toward the intended destination rather than just going fast). Finally, rather than looking at optimizing sail shape, we can look at the effect of changing one Control Variable, the sheeting angle.

FIG. 3 (from page 28, Aero-Hydrodynamics of Sails by Marchaj) shows the effect of sheeting angle (δm), wind speed ($V_A$), and course heading (β) on Velocity Made Good (Vmg) under carefully controlled conditions in a wind tunnel. This shows that a wind speed increase from 10 to 14 knots requires a significant change in both boat heading and sheeting angle to maximize Velocity Made Good. At 10 knots (the second line from the left), the maximum is achieved at a heading of 25° and sheeting angle of 5°. At 14 knots (the third line from the left), the maximum requires a change to a heading of 29° and a sheeting angle of 14°. Failure to make the proper course and sheeting adjustments will result in a decrease in maximum velocity made good of over 10%. While such a minor adjustment is extremely difficult to detect, this could easily cost the race. A 12 minute difference over a 2 hour race is often the difference between first and last place!

This simple illustration shows two critical aspects addressed by the present invention. First of all, it is important, but difficult, to determine what the Optimum Target Setpoints should be. Secondly, it is important, but difficult, to measure small variations in Setpoints and Control Variables (e.g. sail shape and sheeting angle) that significantly affect the boat's performance. The present invention addresses both of these needs, providing accurate data and a means for determining and reproducing optimum sailing conditions.

There is relatively little prior art related to implementing a system that meets both these needs. On the one hand, there are prior inventions that fail to account for anywhere near the complexity of an actual racing sailboat. These prior inventions essentially tie a single sensor (such as wind direction or wind speed through the slot) to a single control variable (such as rudder angle or sail angle). Many of these prior inventions are mechanical attachments that automatically adjust for changes in wind direction in order to keep the boat headed in the right direction or keep the sails somewhat properly adjusted. None adequately account for the huge scale of complexity that is addressed by the present invention. In fact, very few of these types of prior inventions have found commercial use due to their very limited usefulness.

On the other hand, there is a limited body of literature that specifically addresses the aero-hydrodynamic theory of sailing. In these texts, cumbersome experiments are performed using wind tunnels and large sensors that are impractical for use in actual sailboat racing. For example, as recently as 1994 Lombardi and Tonelli published an experimental determination of the pressure distribution on a sail. They used liquid manometers connected by 1.5 mm diameter tubes to probes hung onto the sails. The fluctuations in liquid levels in these manometers were videotaped and then later replayed and manually transcribed to obtain the data desired. Obviously such a cumbersome system could never be used on a racing sailboat.

Another limitation with much of the present body of scientific literature is that the sailor cannot directly measure the data used by the theory. An example is shown in FIGS. 4 and 5. These figures show the desire to plot Apparent course ($\beta$) or true course ($\gamma$) versus velocity made good (Vmg). However, the sailor cannot directly measure Vmg nor $\gamma$ nor $\beta$; he can only measure the boat speed $V_S$ and apparent wind direction ($\beta-\lambda$). Another limitation is that the theories assume that the true wind direction is always constant and that the sailor's desired Vmg is always parallel to the true wind direction. This is normally correct at the start of the race which is always a beat into the wind. However, once the wind shifts (and it always does) or the sailor is no longer directly downwind from the mark, the desired maximization of Vmg changes from the traditional relationships (it is no longer simply $V_S \times \cos \gamma$). Looking at the polar diagram in FIG. 5, a sailor wanting to maximize Vmg in 7 knot winds would always steer a $\gamma$ of 47° (it is difficult from this plot to determine what $\beta$ or $\beta-\lambda$ course to actually steer—recall that the helmsman cannot measure $\gamma$). However, if the wind shifts 20° counterclockwise, the entire polar plot would also rotate 20° and the new max Vmg would be at a $\gamma$ of greater than 47°.

As can be seen, the theory provides many good clues for optimizing sailing performance, but actually implementing the theory is cumbersome if not impossible. Taking the appropriate data and making the calculations and many corrections is extremely difficult and an on-board computerized system as in the present invention is required to properly implement the theory.

Virtually all sailors will have existing commercial sensors that provide wind speed, wind direction, boat speed, boat direction and backstay tension. Sophisticated sailors can also use their global positioning system (GPS) to determine average Vmg. Some may even measure rudder position through their commercial auto pilot device. However, these existing systems fail to measure a wide range of critical pieces of information such as sail shape, sail twist, sail pressure distribution, mast bend, forestay sag, and boat heel. Also, there is no existing system for presenting sensor information or relationships in a useful graphical format for performance optimization. Instead, the sailing literature provides a great many useful tips, rules-of-thumb, and rudimentary notes such as the Trim Card Samples by Whidden and Levitt shown in FIG. 6.

Although various advanced sensors have been applied to aircraft wings, medical devices, and electronics manufacturing, these technologies have not in general been implemented for use on sailboats or recreational boating applications. Application of such sensors requires significant adaptations to implement them on a sailboat or recreational boating application.

Although aero-hydrodynamic theory teaches that certain relationships between factors are extremely important (e.g. boat speed vs. heading or sail shape), there are no known systems available for gathering and displaying such information to the sailor in a useful format.

Take for example, the simple desire to plot maximum boat speed vs. heading for a given wind speed and sail shape. While trying to take this data from existing sensors' analog indicators, the wind speed will vary and shift and the helmsman will vary rudder angle and heading. Thus obtaining even this simple plot is extremely difficult. Add to this the many other factors affecting boat speed and it is readily apparent that this is a time consuming and inaccurate method for obtaining this vital relationship. The racing sailor may need dozens of such relationships, plotting boat speed or velocity made good versus different sail plans, sail shapes, etc. for different wave conditions and wind speeds. Without the present invention, obtaining such relationships could take hundreds of hours and still be somewhat inaccurate.

The benefits of this invention to the racing sailor are thus readily apparent. The system will provide not only accurate measurements, but can also be used to pick out the most important data from a complex jumble of data points to plot critical relationships. The system can calculate and display, for example, the following information:

- Plot Vmg versus boat heading, sail shape, sail plan, sheeting angle . . . for different wind speeds and different sea states.
- Revise Vmg optimization plans as the direction to the mark changes or the wind changes (e.g. rotate the polar diagram and revise all recommended target control settings).
- Wind speed and direction as a function of time (thus the sailor will be able to anticipate future wind shifts).
- Rudder position as a function of time (showing how steady the helmsman is).
- Time required to tack or gibe and regain prior boat speed (showing how fast the crew is at tacking or gibing).
- Fluctuation in tacking time (showing how consistent the crew is or whether they improve during the course of a racing season).
- Time required to make a sail change (showing crew performance and consistency).
- Graphically show the boat heading, wind direction, leeway, and rudder position (shows whether the boat is properly balanced).
- Plot forestay sag and mast bend versus backstay tension at different wind speeds.
- Show sail stress to determine when the sail must be changed or reefed for safety reasons. Also the sail stretch over time may be shown.
- Show current boat speed under current conditions benchmarked against best prior boat performance.

Today, sailors must use trial and error and benchmark their performance against other boats. Thus learning to improve performance may take many years of experience in different conditions against different boats to discover what works best. In fact, many sailors never do learn why they fail to achieve top performance and remain at the back of the fleet forever.

The present invention can be used to benchmark the boat against itself. This performance benchmarking does not require racing against other boats. This dramatically improves the ability to determine optimum settings since the sailing team can concentrate on improving sail trim and boat performance on their own rather than worrying about wind shifts, running into other boats, rounding marks or the many other distractions during a race.

In addition to being of value to the racing sailor, the present invention is of value to the recreational boater as well. Instead of optimizing boat speed, the system can be used to optimize passenger comfort, boat safety, or other desires. Also, if the boat is properly equipped with automatic winches and other hardware, the system can be used for feedback control so that the boat can be piloted automatically or remotely.

The present invention thus provides unique and useful benefits to sailors. The system can take existing sensor information and present it in a more useful format showing important relationships and/or graphical format. New sensors can also be added to the system to measure critical parameters and further improve sailboat performance. Since the system is modular, a simple base system can be installed on a boat and new sensors and software upgrades can be added over time.

SUMMARY OF THE INVENTION

The present invention is a modular system of sensors, data acquisition, computational analysis, graphical display and optional feedback control for optimizing sailboat and crew performance.

Sensors are located throughout the boat in order to accurately measure critical parameters (such as boat speed, sail shape, sail pressure, boat heel, sea state . . . ). These sensors can be commercially available or new sensors as described in this patent. The sensors must not interfere with the boat's performance and must be small, robust, and corrosion resistant. Over 15 sensors and sensor arrays are described in this patent and can be used in any combination.

The sensor data is acquired, analyzed, and displayed to the sailor as useful information that may be used to optimize sailboat and crew performance. The data may be filtered, time averaged, time delayed or transformed using a variety of user defined algorithms. The data may be displayed as a function of time or used to display a variety of complex relationships that can be used to optimize sailboat and crew performance. Over 30 information and relationship displays are described in this patent and can be used in any combination.

Optionally, feedback control may also be incorporated, using appropriate equipment such as electronic winches so that the boat may be controlled automatically or remotely.

The present invention is thus a flexible, modular, systems concept and approach to measuring and optimizing sailboat and crew performance. The present invention may be embodied as a modular on-board computer system with all the associated sensors, power supplies, hardware, software, display, data storage, and user input devices.

BRIEF DESCRIPTION OF DRAWINGS

FIG. 1A shows the velocity vectors for the True Wind Speed, Apparent Wind Speed, Boat Speed, and Velocity Made Good as well as defining the angles between these vectors. The Boat's velocity vector will be slightly offset from the boat's apparent heading being steered and this is defined as the Leeway ($\lambda$). FIG. 1B shows a diagram of a jib sail depicting the various terms for different parts of the sail. The distance between the actual camber of the three dimensional sail and an imaginary straight line chord between the luff and leech of the sail is termed the Draft. The Draft Depth is defined as the maximum draft divided by the chord length, expressed as a percentage. The Draft Location is defined as the distance from the luff at which the maximum draft occurs divided by the chord length, expressed as a percentage.

FIG. 6 (taken from "The art and science of sails" by Whidden and Levitt) shows trim card samples that the sailor may use for taking notes to document apparently optimum sail trim. As can be seen, such rough notes can only approximate optimum conditions, especially when the approximate measurements are made visually.

FIG. 11 shows performance benchmarks for different sails and wind speeds. Each figure shows boat speed as a function of boat heading for different sail plans. The top figure shows the relationship given a wind speed of 10 knots, the second part of the figure shows this at 17 knots and the bottom part of the figure at 24 knots. It can readily be seen that the optimum combination of sails depends on the wind speed and desired heading.

FIG. 12 shows different performance benchmarks under the same conditions as the 10 knot wind speed graph in the previous figure. In addition to showing boat speed in the upper figure, the second figure shows Velocity Made Good to Windward (note that the VMGtW goes to 0 at 90° when the boat is traveling at right angles to the desired destination. The VMGtW is shown as positive from 90° to 180° for convenience, even though the boat is actually going with the wind.). The bottom figure shows Velocity Made Good to at Mark at 45° and demonstrates that the optimum heading is not necessarily the layline or rhum line. (Note that the VMGt45 goes to 0 at 135° when the boat is traveling at right angles to the desired destination. The boat would never head at greater than 135° to reach a mark at 45°.)

DESCRIPTION OF THE PREFERRED EMBODIMENT

The present invention is a modular system and thus comprises various building blocks of sensors, data acquisition systems, computational analyses and displays. In its most basic configuration, all of the sensors may consist of existing prior art (commercially available sailing sensors) and the information and relationships displayed may be based primarily on existing sailing theory as taught in the literature. Although there may be undocumented prior art related to putting existing sensor information into a computer, the present invention is unique and innovative in that its capabilities and usefulness go well beyond such prior art to offer a commercially-feasible, modular system for complete sailboat and crew performance optimization.

In particular, the present invention goes beyond simply acquiring the signals from existing sensors and plotting the information graphically. The present invention presents a systems approach to optimizing sailboat performance. This is an innovative approach to optimizing such a complex multi-dimensional situation by measuring the right information and presenting the decision maker with appropriate relationships to use for optimizing various aspects of boat performance (speed, velocity made good, safety, comfort . . . ) or crew performance (helm control, tacking speed and consistency . . . ). Also, with the proper hardware, such as electronic winches, the present invention has the ability to provide feedback control of the sailboat as well.

The preferred embodiment of the present invention can be broken into the sensors, data acquisition, computational analysis, information displays, and optional feedback control.

The preferred embodiment comprises any combination of the following sensors:

1. Sail Shape, Pressure, Strain and Wind Flow Sensor Arrays on Each Sail

Figure 7:
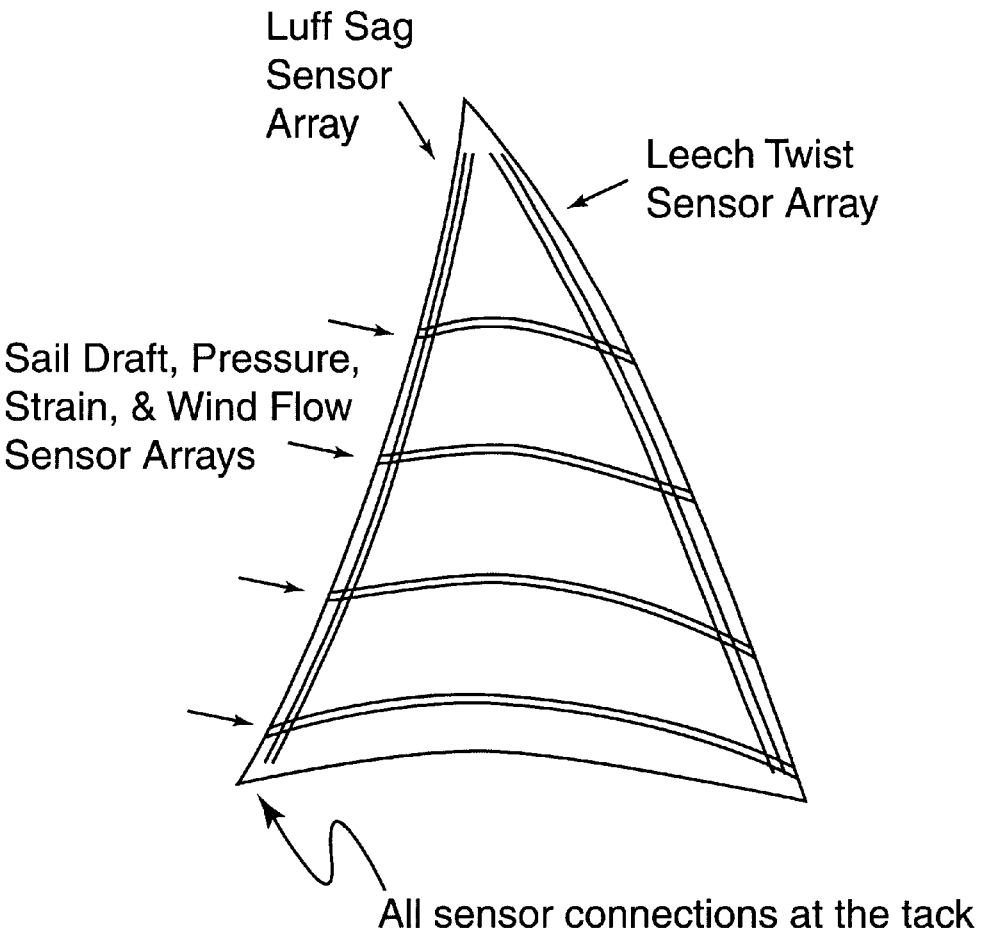
FIG. 7 shows an example of sail sensor array locations on a jib sail. Multiple sensor strips, incorporating draft, pressure, strain and/or wind flow sensors are sewn (or attached with Velcro) horizontally into the sail (potentially along the broadseams). A luff sag sensor array and leech twist sensor array are also shown.

In the preferred embodiment, all four of these measurements will be taken from a series of horizontal sensor strips that are attached or directly sewn into the sails themselves. An example set of locations for these sensor arrays is shown in FIG. 7.

The sensors may be of any type that has sufficient durability, flexibility and fatigue resistance. In one embodiment, the sail shape measurement is based on a series of optical fibers such as used in the "Shape Tape" system by Measurand. Fiber optic pressure sensors could be used, such as the PS-100 by FFPI Sensors, fiber optic strain gauges may be used and the wind flow sensors may be hot-film anemometers. In this potential embodiment, the laser light source(s) and detector(s) would be located inside the boat and attached to the sail by a connecting mechanism. Similarly, any electrical connections would run along the sail to the tack and then be connected to the data acquisition system inside the boat through a connecting mechanism.

Another embodiment would integrate shape, pressure and strain sensors into a single fiber optic bundle rather than using three separate sensor systems. Another embodiment would measure pressure using non-fiber optic methods such as the piezoresistive sensors sold by Motorola (e.g. their CASE 344-15 or CASE 867-08 or many others) or variable reluctance pressure transducers. Another embodiment would use standard electrical strain gauges. Another embodiment would measure only the sail's shape, or only the pressure, only the wind flow or any combination of signals other than the four described in the preferred embodiment.

The specific embodiment of the sensor array itself is not critical and will vary depending on the accuracy desired, the total number of commercial units to be delivered, and development of new technologies.

2. Twist Sensor Array on Each Sail

In addition to the horizontal sensor arrays on each sail, the preferred embodiment will incorporate a leech twist sensor as shown in FIG. 7. This sensor is essentially the same as the sail shape sensor above. It may also incorporate strain, pressure and/or wind flow sensors.

3. Luff Sag Sensor Array on Jib

In addition to the horizontal sensor arrays on each sail, the preferred embodiment will incorporate a luff sag sensor in the jib as shown in FIG. 7. This sensor is essentially the same as the sail shape sensor above. It may also incorporate strain, pressure and/or wind flow sensors.

In another embodiment, the luff sag sensor may be incorporated into the forestay rather than the jib sail and may use a different sensor technology than used in the sails.

4. Angle of Attack Sensor for Each Sail

This sensor measures the angle of incidence between the apparent wind direction and the sail. This sensor must be very accurate to measure small angular differences. Although there is prior art for measuring angle of attack, most of these inventions assume that the angle of attack is optimized when the difference in air flow from one side to the other is minimized. In contrast, the present invention's preferred embodiment is to measure the angle of attack independent of variation in air flow.

In the preferred embodiment a relatively simple rotational measuring device is used to measure the sail's angle relative to the boat's centerline. The measuring device is affixed to the sail and the forestay or mast and measures the rotation of the sail about the forestay or mast. When combined with the measured apparent wind direction sensor, the angle of attack can be calculated. Other embodiments of this sensor could operate by measuring the angular twist of a cable running along the forestay, attaching the sail to a rotatable rod that is attached to the forestay or mast, or any other embodiment designed to measure the angle of the sail or the variation in air flow from one side of the sail to the other or any other indication of angle of attack.

5. Mast Deflection Sensor Array

This sensor array measures the deflection of the mast. Similar to the luff sag sensor, the sensor may either be incorporated into the luff of the main sail or into the mast itself. In the preferred embodiment, the sensors will be incorporated into the mast so as to measure both deflection from bow to stern, as well as from side to side. Another embodiment incorporates sensors specifically related to boat safety such as stress or strain on the mast.

6. Boat Heel Sensor

This simple sensor measures the amount of boat heel and will ideally be located near the boat's center of gravity. In one simple embodiment, the amount of deflection or rotation of a weighted pendulum is monitored. More sophisticated embodiments could incorporate accelerometers to monitor the variability in heel as well as the heel itself.

7. Boat Yaw, Pitch and Roll Sensor

This sensor will ideally be located near the boat's center of gravity and will monitor the boat's yaw, pitch, and roll. More sophisticated sensors could also incorporate accelerometers. This sensor can be used to estimate sea state (the wave condition such as amount of swells and chop) as well as provide information related to the comfort of the ride. The sensor information can be used to provide either a single sea state value (e.g. a value of 1 may indicate calm waters, 4 may indicate choppy 2–3 foot waves, and 8 may indicate large swells and 4–5 foot waves . . . ) or continuous sea state values related to waves impacting on the boat. An alternative use of this information would be to use the data to "filter" other data. For example, wave action will cause the apparent wind speed and direction, sail shape, and boat speed to fluctuate—thus, the wave information can be used in an algorithm to smooth out the apparent information to derive the "true" information.

8. Standing Rigging Tension Sensors

The backstay, forestay and other standing rigging can easily incorporate tension sensors. Many backstays already incorporate a hydraulic or pneumatic tensioning device (such as a pump) along with a dial gauge for pressure. Any indirect indication of stay tension (such as gauge pressure) will assist in optimizing sailing performance, but a direct measurement of tension is better since this measure will show the influence of external factors such as wind speed and shock as the boat pounds through the water.

In the preferred embodiment a load cell is incorporated as part of the rigging, by connecting the stay to the load cell which is then connected to the boat. Other embodiments could include a clip-on extensometer clipped onto the existing rigging, or the use of strain gauges, or other load or tension or strain measuring devices.

9. Running Rigging Position and Tension Sensors

These sensors include a wide variety of alternative measuring methods depending on whether the running rigging is a sheet, car, traveler, outhaul, boom vang, etc. Many racing sailors use a numbering system or marks on the lines to indicate changes in position. Thus a sailor may move the jib sheet car forward from hole 8 to hole 5 when going from a beat to a beam reach. Although the present invention allows for the sailor to manually input position-indicating numbers into the system, a preferred embodiment is to use sensors to more accurately measure these positions and tensions.

Any combination of sensors can be used to make the appropriate measurements for a given line. For example the traveler may incorporate a linear variable displacement transducer to measure where the traveler car is from its most port to most starboard position. An alternative embodiment would be to use a series of proximity sensors (either inductive, capacitive, ultrasonic, photoelectric, magnetic . . . ) in the traveler track to measure where the car is. For example, sheet positions can be measured using proximity sensors or by running the line through a pair of rollers to measure the length of line which has passed between the rollers. Line tension can be measured directly by sensors in the lines or can be inferred by the electrical power needed to tighten a winch. The variety and types of sensors used will depend on the accuracy desired, number of units delivered, cost, esthetics, and new technology.

10. Spinnaker Pole Sensor Array

The most critical need is to measure the position of the outer end of the spinnaker pole. Thus this sensor array could measure the pole car height and pole angle or it could measure the downhaul line position, guy line position and pole car height. Another embodiment would incorporate safety measurements such as pole stress and strain. Similar to other sensors, alternative embodiments could include any sensors that provide the appropriate information.

11. Hull, Keel, and Rudder Sensors

These sensors are below the waterline and provide information related to the flow of water over the hull, keel, rudder, trim tabs, keel wings, etc. In one embodiment, a pair of paddle wheel water speed indicators would be located on either side of the keel to provide information related to the keel's angle of attack with the water flow. Since the direction of water flow can be affected by currents as well as boat speed, wind and wave conditions, the racing sailor often has no information related to the boat's movement through the water with which to optimize rudder angle, trim tabs, keel wings, leeway, heel, or boat heading.

Figure 8:
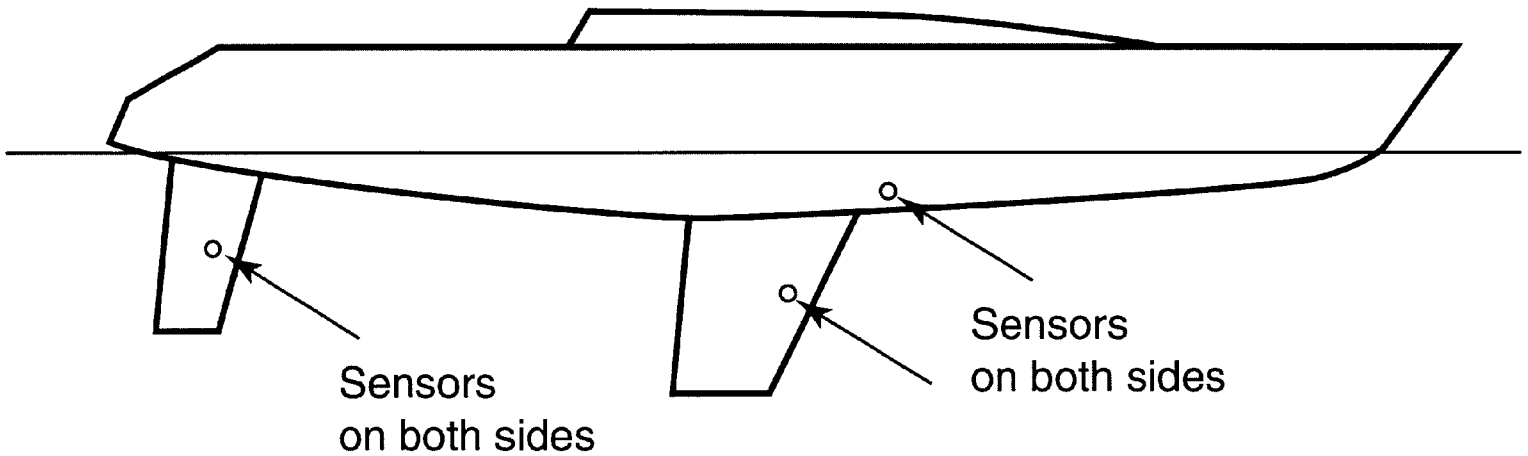
FIG. 8 shows potential locations for hull, keel, and rudder water flow sensors below the waterline. The sensors would be placed on both sides of the boat at each location shown, so that the difference in water flow from one side to the other may be determined.

FIG. 8 shows one potential embodiment that illustrates locations for water speed sensors below the waterline. Various alternative sensors can be used to replace the traditional paddle wheel water flow sensors. Alternative sensors could also be used to monitor not only water flow but also to indicate whether the flow is laminar or turbulent.

12. Global Positioning System (GPS) Information (Existing Commercial Sensor)

Some information cannot be acquired directly from a boat's sensors, such as the boat's location on the earth. It is difficult or impossible to accurately measure the boat's leeway ($\lambda$) or Vmg without somehow externally obtaining the boat's position relative to some fixed point in space. Thus the present invention will interface with commercially available navigation systems such as global positioning systems or other such methods.

13. Boat Speed (Existing Commercial Sensor)

There are presently a number of commercial boat speed sensors and virtually every racing sailor will already have such a sensor on the boat. Thus the present invention will interface with these commercially available sensors. In one embodiment, the present invention will acquire the data from such sensors using the NMEA communication standard.

14. Boat Heading—Flux Gate Compass (Existing Commercial Sensor)

There are presently a number of commercial boat heading sensors. Thus the present invention will interface with these commercially available sensors. In one embodiment, the present invention will acquire the data from such sensors using the NMEA communication standard. In another embodiment, the present invention will acquire the data by interfacing with a boat's existing commercial auto pilot system.

15. Wind Speed and Direction Sensor (Existing Commercial Sensor)

There are presently a number of commercial wind speed and direction sensors and virtually every racing sailor will already have such sensors on the boat. Thus the present invention will interface with these commercially available sensors. In one embodiment, the present invention will acquire the data from such sensors using the NMEA communication standard. Other potential embodiments would include using multiple sensors at different heights since the wind speed changes with height above the water. Thus sail twist and shape can be better optimized if wind speed and direction are measured at multiple heights.

16. Rudder Position Sensor (Existing Commercial Sensor)

There are presently a number of commercial rudder position sensors. Thus the present invention will interface with these commercially available sensors. In one embodiment, the present invention will acquire the data from such sensors using the NMEA communication standard. In another embodiment, the present invention will acquire the data by interfacing with a boat's existing commercial auto pilot system.

17. Other Information Sources

Other information sources or sensor systems may be integrated into the present invention. For example, instead of using the aforementioned sail shape measuring system, an external camera may be used to view the sail and calculate the sail's shape, such as in the SailSpy or Sailscope system used by the Australians in the America's Cup competition. Other sources of information could be obtained from the Internet (such as weather conditions) or via telemetry from other sources. Alternative data may include fuel level, fuel consumption, battery charge, energy consumption, water levels, barometric pressure, air and water temperature, etc.

The basic configuration of the present invention may only contain a few of these sensors. However the invention is modular and flexible so that sailors may add new sensors at any time to further improve sailing performance. Thus the present invention could contain anywhere from one or two of these sensors up to all of these and other sensors in virtually any combination.

The sensors, as described heretofore, may require or include associated equipment. For example an embodiment of the fiber optic pressure sensor may include a laser source, detectors, power supply and its own integrated circuits to interpret the data and output a digital signal that requires no further conditioning. Other sensors may provide a 1–10 V analog signal. Other sensors may include sophisticated GPS instrumentation as well as computers. Also, instead of the system automatically recording sensor signals, the sailor may input information manually to replace sensors. Thus, instead of using a jib car position sensor, the sailor may manually input a number into the system to show which hole the jib car is in or how many inches from the front of the track the car is.

The preferred embodiment of the present invention also comprises data acquisition systems, hardware and software. One preferred embodiment comprises a power supply, PCI passive backplane, industrial single board computer card, signal conditioning cards, input/output cards, flash memory card, graphics card, communications card, hard drive, floppy disk drive, LCD display monitor, and all associated hardware and software. Other preferred embodiments include use of alternative backplane communication standards (ISA, EISA, . . . ); proprietary communication standards; motherboards; more, fewer or different cards; different storage media; or any other hardware required to implement the systems concept for optimizing sailboat performance. In one preferred embodiment, the operating system will be Windows NT. Other preferred embodiments include any other operating system such as other Microsoft operating systems, Macintosh, UNIX and others. In essence, the present invention comprises any hardware and software system capable of acquiring sensor signals, performing computational analysis and displaying the information or relationships for the purposes of optimizing sailboat and crew performance.

The preferred embodiment of the present invention also comprises the computational analysis and graphical display of information and relationships for the purposes of optimizing sailboat and crew performance. Since the preferred embodiment is modular, the display of information is also modular and ranges from graphing the raw data, to showing heavily modified data, to displaying complex relationships, to showing recommendations. One embodiment comprises the following information and relationship displays:

1. Apparent wind speed as a function of time. (This may be displayed as raw data or various data manipulation algorithms can be selected to smooth out the information and show general trends and predict the next shift.)
2. Apparent wind direction ($\beta-\lambda$) as a function of time. (This may be displayed as raw data or various data manipulation algorithms can be selected to smooth out the information and show general trends and predict the next shift.)
3. True wind speed as a finction of time. (This data must be calculated based on apparent wind speed and direction, boat speed and direction, and the angles between them and cannot be measured directly. This may be displayed using various data manipulation algorithms to smooth out the information and show general trends and predict the next shift.)
4. True wind direction as a function of time. (This data must be calculated based on apparent wind speed and direction, boat speed and direction, and the angles between them and cannot be measured directly. This may be displayed using various data manipulation algorithms to smooth out the information and show general trends and predict the next shift. It will be especially important and innovative to be able to show this relationship despite significant changes in boat heading such as tacking and jibing.)
5. Boat speed as a function of time. (This may be shown alongside or underneath other data as a function of time. For example, by comparing this plot to boat direction as a function of time, the "time to complete a tack" and regain former speed may be determined.)
6. Sailing efficiency or relative boat speed may be shown by dividing the boat speed by the wind speed. This relationship will help factor out rapid changes in wind speed from affecting diagnostic relationships such as time to tack and regain boat speed. More complicated efficiency measures may also be devised, for example, to incorporate the time delay between a change in wind speed and the resulting change in boat speed.
7. Boat heading as a function of time. (This information may be acquired from a compass. More importantly, all compasses show magnetic heading rather than true heading and all compasses are subject to small deviations due to the presence of magnetic materials on the boat. Thus, the "onboard system compass" may be calibrated to be the "corrected" compass heading at all times and the sailor would not need to use deviation charts as is presently the case.)

Figure 1A:
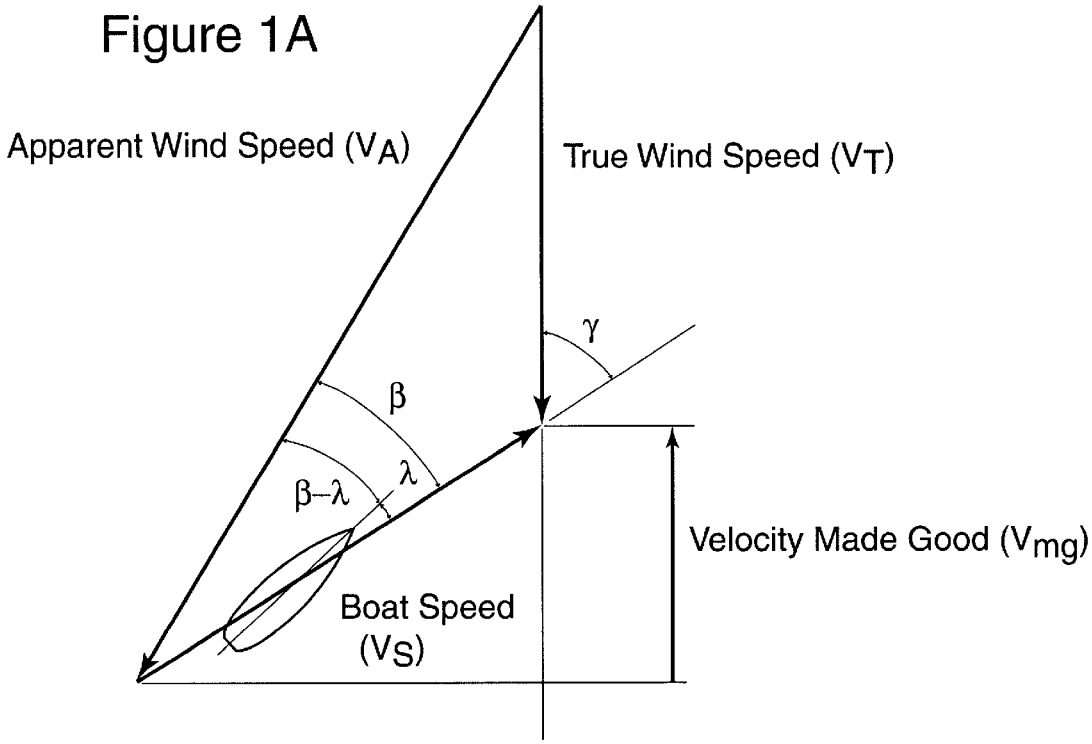
FIGS. 1A and 1B provide definitions and terms for many of the concepts discussed in this patent.
Figure 1B:
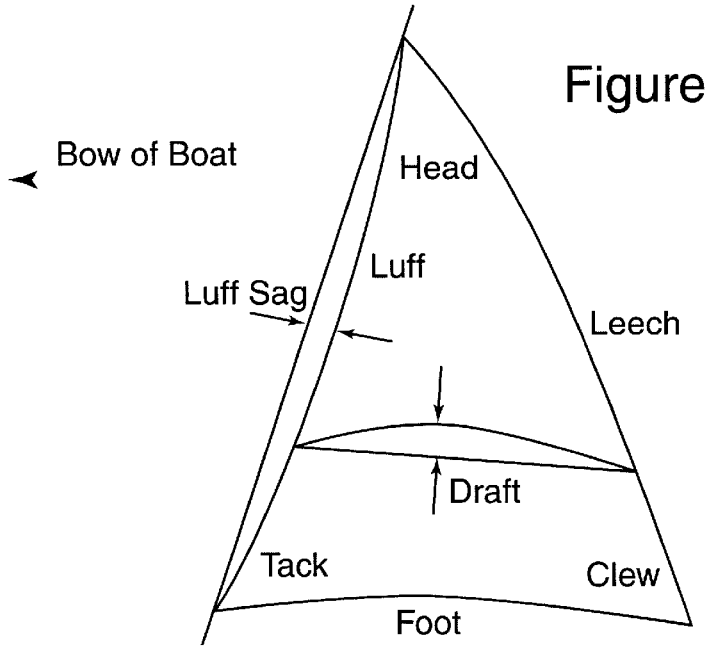
Figure 2:
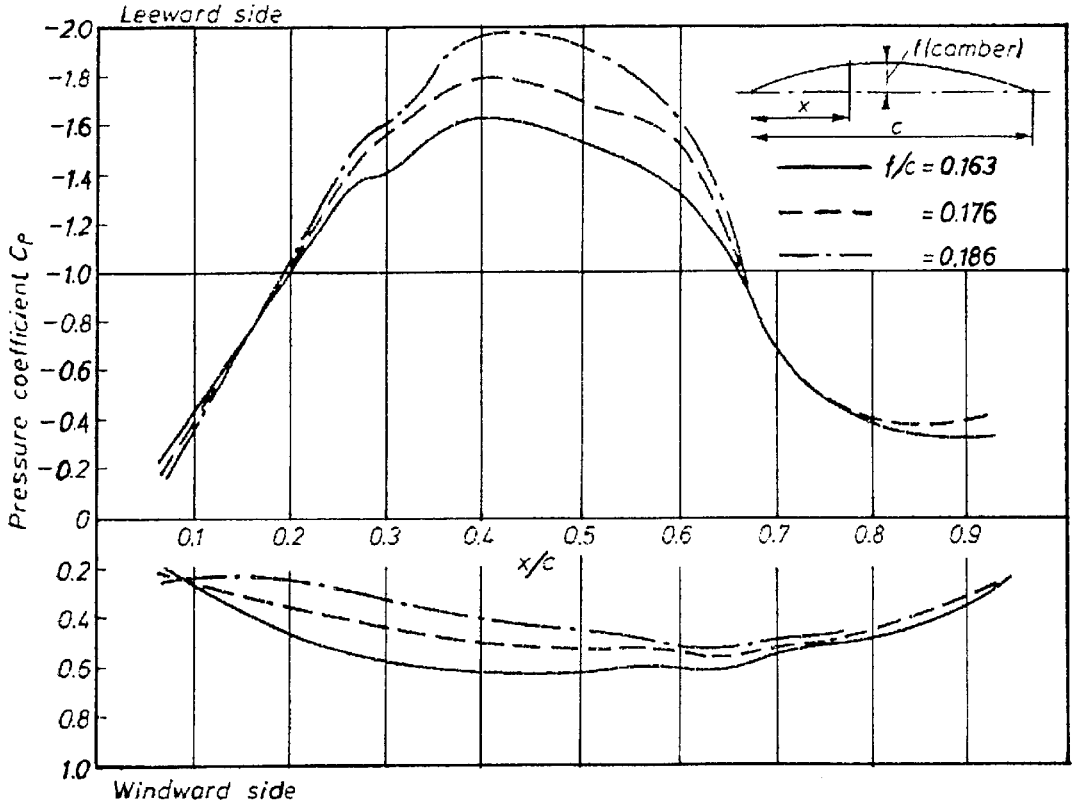
FIG. 2 (taken from page 329, "Aero-hydrodynamics of sailing" by Marchaj) shows the pressure distribution along a sail at three different cambers as shown. This drawing shows that very small changes in sail shape have a significant effect on pressure distribution (and thus boat speed).
Figure 3:
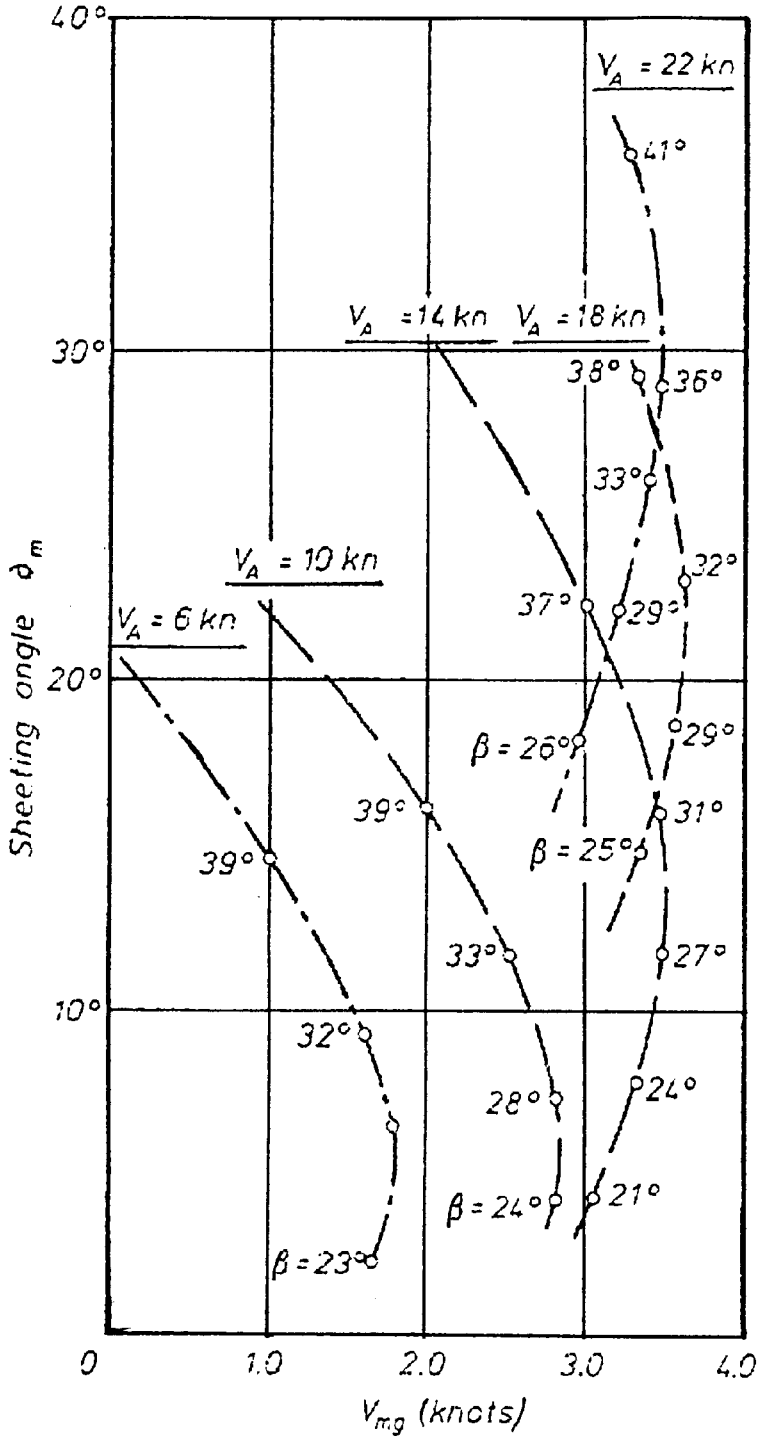
FIG. 3 (taken from page 28, "Aero-hydrodynamics of sailing" by Marchaj) shows the effect of sheeting angle on velocity made good for different apparent wind speeds. This drawing shows that change in wind speed has a significant effect on the optimum boat heading and sheeting angle.
Figure 4:
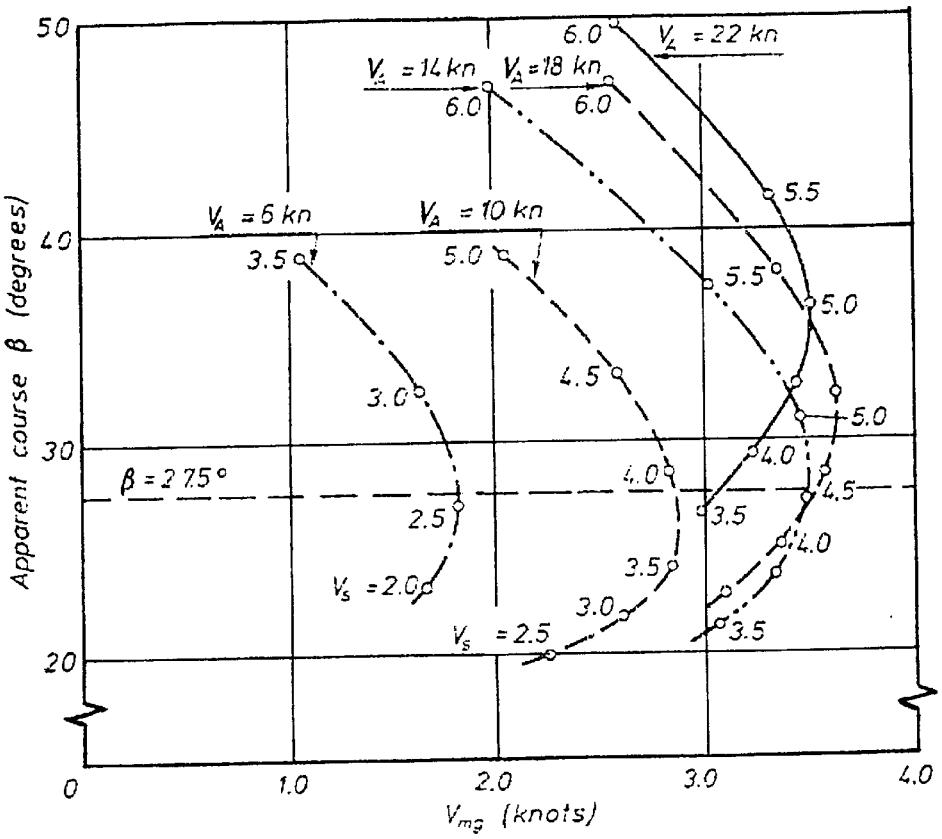
FIG. 4 (taken from page 27, "Aero-hydrodynamics of sailing" by Marchaj) shows the effect of apparent course heading on velocity made good for different apparent wind speeds. This drawing shows that change in wind speed has a significant effect on the optimum boat heading. This drawing also shows that the theory is extremely difficult to apply in practice since the sailor cannot directly measure either of the axes of this figure.
Figure 5:
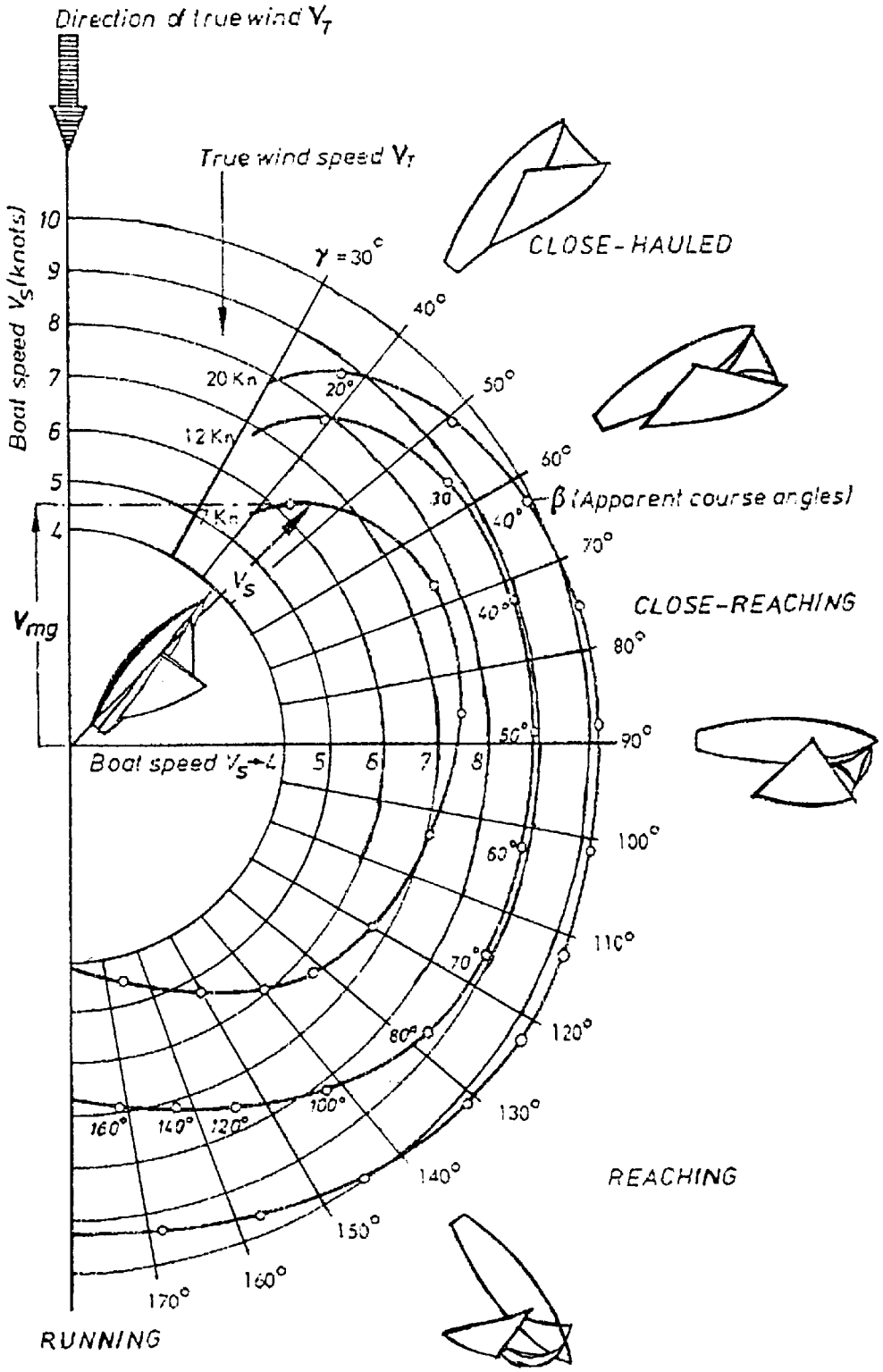
FIG. 5 (taken from page 71, "Aero-hydrodynamics of sailing" by Marchaj) shows the effect of true course heading on boat speed and velocity made good for different apparent wind speeds. This drawing shows that change in wind speed has a significant effect on the optimum boat heading. This drawing also shows that the theory is extremely difficult to apply in practice since the sailor cannot directly measure or use some of the information required in the figure. The polar diagram is also useful for understanding the difference between velocity made good towards the true wind and velocity made good towards the intended destination.
Figure 9:
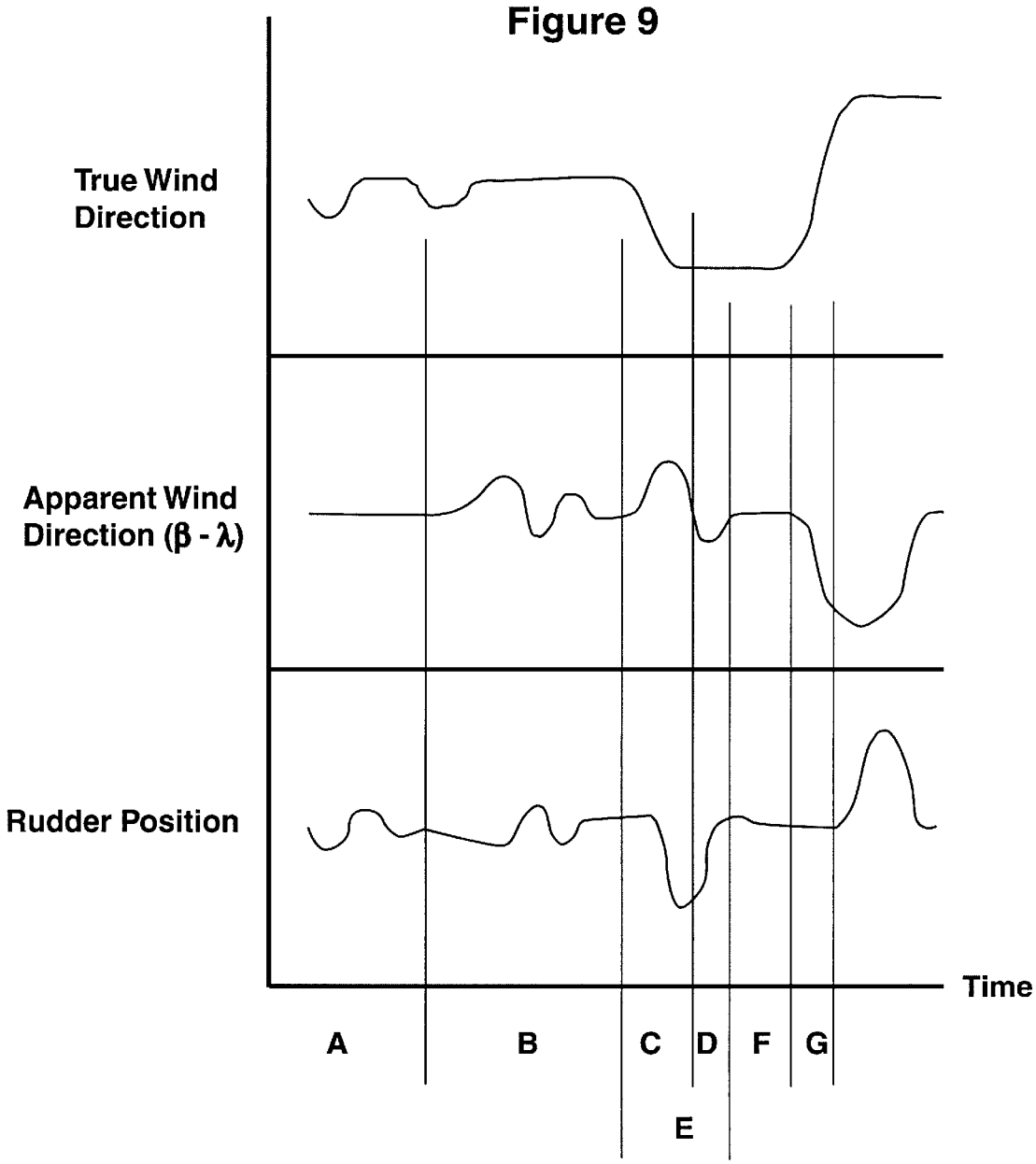
FIG. 9 shows diagnostic relationships for improving helm control. Three sensor signals are shown on the same time scale. Seven specific diagnostic assessments are shown in this example. For example, at A, the rudder control is excellent and the apparent wind direction remains constant even though the true wind direction is shifting. In contrast, at B, the wind is not shifting, yet apparent wind direction is shifting, thus indicating poor rudder control.
Figure 10:
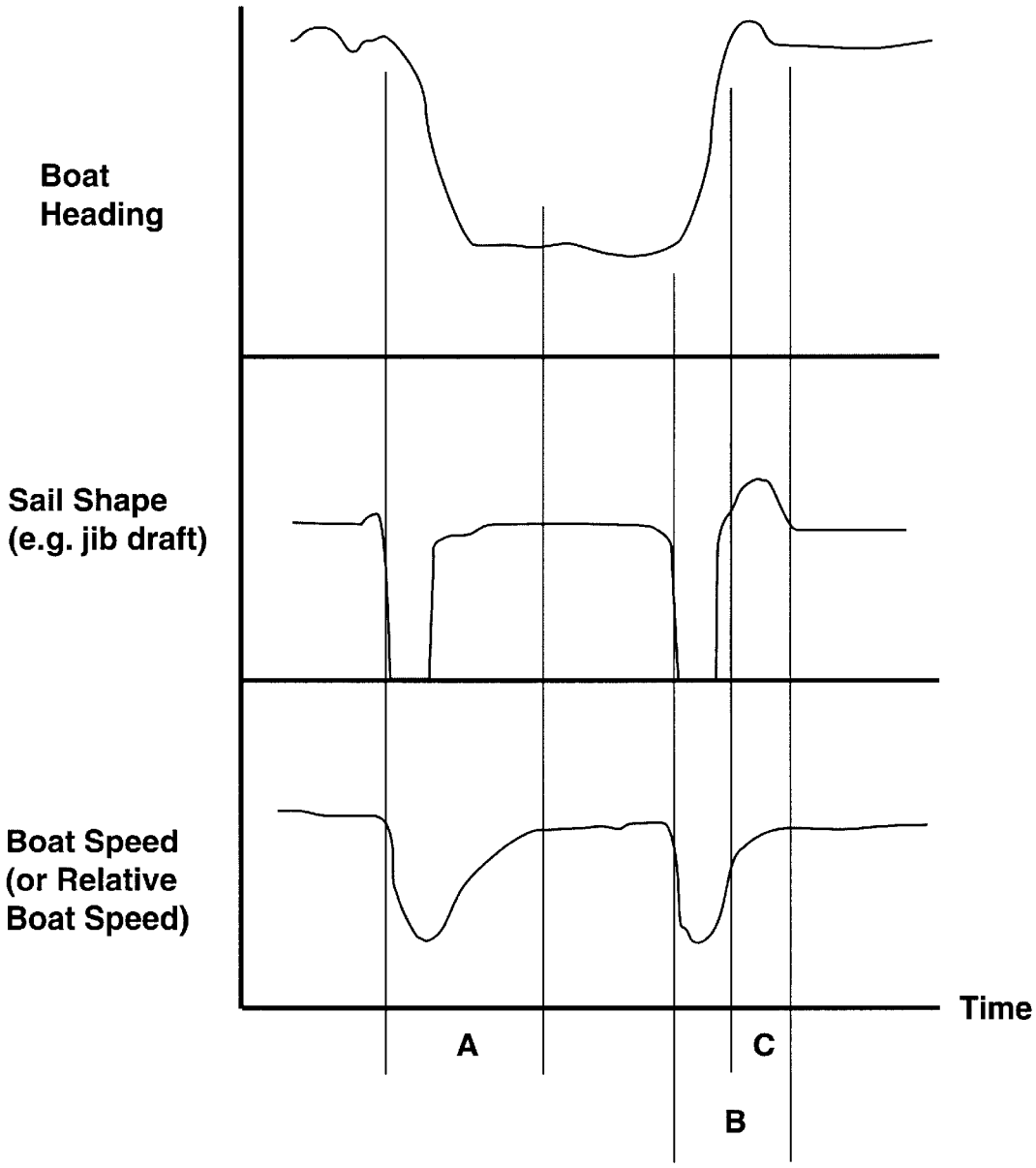
FIG. 10 shows diagnostic relationships for improving tacking performance. Three sensor signals are shown on the same time scale. Three specific diagnostic assessments are shown in this example. For example, A shows the time it takes to complete the tack and regain former boat speed (or a relative boat speed to account for the possibility of the wind speed having changed during the time to tack). B shows an alternative tacking tactic that results in a faster tack.

8. True boat heading as a function of time. (This information must be calculated based on referencing a fixed point in space and may be obtained, for example, from a GPS.)
9. Boat leeway ($\lambda$) as a function of time. (This information must be calculated based on the previous two readings.)
10. Boat leeway as a function of apparent wind speed and direction, true wind speed and direction, boat heading . . .
11. Heading adjustment lag time. (In some cases, the sailor may wish to maintain a steady heading while optimizing boat speed. In other cases, such as beating upwind, the sailor may wish to maintain a steady apparent wind direction ($\beta-\lambda$) and change heading to compensate for wind shifts. In either case, whenever the wind shifts, there will be a lag before either the sail trim is re-adjusted to optimize speed or before the heading is altered to maintain a constant ($\beta-\lambda$). This "lag time" may be determined as illustrated in FIG. 9 and shown as a separate relationship. A "lag time" histogram may be shown to indicate whether the helmsman or crew is consistent or whether there are large fluctuations in lag time.)
12. Rudder position as a function of time. (This information may be displayed as raw data. It may also be displayed along with other information as a diagnostic device, such as in FIG. 9, to determine how steady the helmsman is, whether he over steers, whether the boat is properly balanced with weather helm . . . )
13. Rudder position as a function of boat heading or apparent wind direction or sea state. (Various relationships may be used to indicate how consistently the helmsman maintains or changes a given heading and properly adjusts the rudder. Information can be used to determine if the helmsman over steers during tacks or is too heavy handed in adjusting for waves . . . )
14. Tacking or gibing diagnostic relationships. (As shown in FIG. 10, the time to tack and regain boat speed can be determined. Various alternative tactics may be explored, such as footing off after a tack to regain boat speed before adjusting to the optimum apparent wind angle. A histogram of tacking time may be used to determine crew consistency. These relationships can be used to optimize how fast the boat is brought about, how much overshoot and footing off to use, whether too much rudder is applied . . . )
15. Sea state as a function of time. (The roll, pitch, and yaw sensor can be used to calculate the sea state. This can either be an average sea state (such as the waves are 2–3 feet and choppy) or it can be as a function of time (such as showing that waves are regularly pounding against the bow). Various calculated factors may be plotted as a function of time such as wave crests and troughs.)
16. Sail pressure, strain or force distribution. (This information must be calculated from the raw data such as laser light intensity, diaphragm deflection or voltage. The calculated pressure may be shown along each horizontal strip as in FIG. 2 or isobars can be mapped to display the sail with different colors for different pressures. Similarly, strain or force may be displayed in a variety of formats.)
17. Wind flow over the sails. (This information may be plotted in a wide variety of formats. One way would be to show the sail with hundreds of small telltales so that the sailor may use prior experience to adjust sail trim. Another way would be to show the time averaged wind speed values themselves or to show vectors with different lengths to illustrate higher and lower wind speeds . . . )
18. Sail shape. (This information must be calculated from the raw data such as laser light intensity. This information may be shown as continuous data or as simple form factors such as maximum draft depth (draft depth divided by chord length) or maximum draft locations (distance from the luff divided by chord length) at different locations in the sail.)
19. Sail safety information. (As the wind speed increases, the sail fibers may exceed their yield strength and begin to stretch. In other cases, small rips may appear and go unnoticed. The sail may need to be reefed or changed.)
20. Sail stretch. (As a sail wears out or is used in winds that are too high, the sail will stretch and no longer be able to achieve maximum performance. In other cases, small rips may appear and go unnoticed. Thus, appropriate monitoring will show when a sail requires servicing or replacement.)
21. Keel angle of attack, rudder angle of attack . . . (the water flow differential between sensors placed on opposite sides of the keel, hull, rudder, trim tabs . . . can be used to determine the angle of attack and maximize the boat's lift while minimizing drag.)
22. Boat speed as a function of jib sail shape, main sail shape, backstay tension, forestay sag, line positions and tension . . . (In essence, any measurement may be graphed against any other measurement.)
23. Maximum boat speed for a given wind direction, wind speed and sea state. (The sailor will make a host of sail trim adjustments to maximize boat speed. However, while these adjustments are being made, many other factors will vary such as wind speed. Thus, sophisticated interpolation calculations must be made to determine what the maximum boat speed would be if all these other factors were able to be held constant. In one embodiment, these interpolation calculations would be made using a neural network.)
24. Optimum sail shape, pressure distribution . . . to obtain the maximum boat speed for a certain wind direction, wind speed, and sea state. (Similarly, the system must be able to interpolate these optimum setpoint targets from a host of specific data sets. In one embodiment, these interpolation calculations would be made using a neural network.)
25. Forestay sag as a function of backstay tension. (Various such plots would be determined for different wind speeds, headings and sail plans. These are useful relationships for determining which control variable to adjust.)
26. Maximum boat speed as a function of true wind direction and speed for different sail plans. (Instead of the polar diagrams used in the literature, an easier to use relationship is shown in FIG. 11. These relationships clearly show when to change sails and which heading optimizes boat speed.)
27. Maximum velocity made good (Vmg) as a function of true wind direction and speed. (Instead of the polar diagrams used in the literature, such as FIG. 5, an easier to use relationship is shown in FIG. 12. These relationships also show the difference between Vmg to windward (the standard definition of Vmg) and Vmg toward the intended destination, for example a mark at 45°.

This definition of Vmg essentially rotates the polar diagram whenever the wind shifts direction or whenever the direction to the mark is not directly upwind or downwind. These relationships clearly show when to change sails and which heading optimizes Vmg.)

28. Any measured information can be displayed. Alternatively, the sailor may input information manually (e.g. instead of measuring line position with a sensor, the sailor may manually input a value). Any of these values may be displayed in relationship to any other values.

29. The sensor information may be modified by various selectable algorithms (to time average, filter, time delay . . . ). For example since the boat speed will take some time to react to an adjustment, the sailor may wish to incorporate a time delay when displaying a relationship between a factor and boat speed. Information from the sea state sensor may be used as part of an algorithm to filter other data to factor out the effect of waves.

30. The sailor may define various conditions to display (e.g. a User Defined display may be to plot boat speed against wind speed only when the rudder is between 4 and 6°, the heel is less than 15°, and the wind speed has not fluctuated by more than 1 knot for at least 20 seconds).

31. Multi-dimensional relationships may be used to determine robust setpoint conditions. The sailor may desire to optimize comfort by trimming the sails so that they are least affected by variations in external factors (during meals, when cruising at night . . . ).

32. Racing performance analysis. (The sailor may desire to benchmark sailboat and crew performance against prior races rather than against the best performance the boat is capable of. This shows whether the crew is improving over time.)

Another embodiment of the present invention incorporates PID and/or fuzzy logic and/or neural network and/or genetic algorithms and/or other artificial intelligence technology. Many inter-relationships between factors are too complicated to understand using mere two or three dimensional displays. Determining optimized conditions only from displaying relationships may be impossible given the many changing factors. Thus, incorporating advanced artificial intelligence tools such as fuzzy logic and/or neural networks will allow the sailor to better optimize sailboat performance.

In one preferred embodiment, the sailor may teach the neural network to recommend optimized conditions. In another preferred embodiment, the neural network will learn the relationships between factors and thus be able to predict an optimum benchmark boat speed or other factor for new conditions even if the boat has never been sailed in those conditions before. In another preferred embodiment, the neural network will learn all the relationships between all the various parameters; the sailor may then query the system to determine the probable outcome of changing something. In this embodiment, the sailor may alternatively determine robust conditions where small variations in control variables will have the least effect on setpoint targets (or small variations in external factors have the least effect on setpoint targets). This would be especially important in determining the safest sailing conditions.

In another preferred embodiment, the boat is equipped with electronic winches, auto pilot, and other appropriate hardware and the system will provide feedback control over the boat's performance and the boat may be operated automatically or remotely.

The foregoing description of the present invention has been presented for purposes of illustration and description. Furthermore, the description is not intended to limit the invention to the form disclosed herein. Consequently, variations and modifications commensurate with the above teaching, and the skill and knowledge of the relevant art, are within the scope of the present invention. The embodiments described hereinabove are further intended to explain best modes known for practicing the invention and to enable others skilled in the art to utilize the invention in such, or other, embodiments and with various modifications required by the particular applications or uses of the present invention. It is intended that the appended claims be construed to include alternate embodiments to the extent permitted by prior art.

What is claimed is:

1. A system for acquiring and evaluating performance data of a sailboat, the system comprising:

at least one sailboat performance sensor for acquiring data indicative of a performance parameter of the sailboat;

at least one control variable sensor for acquiring data indicative of a control variable of the sailboat;

at least one external factor sensor for acquiring data indicative of an external factor of the sailboat; and correlating means for correlating the performance parameter with the control variable and the external factor for determining an optimized setpoint of the control variable for operating the sailboat under conditions indicated by the external factor.

2. The system of claim 1, wherein the correlating means comprises a computer for correlating the performance parameter with the control variable for determining an optimized setpoint of the control variable for operating the sailboat.

3. The system of claim 1, wherein the correlating means comprises an artificial intelligence system for correlating the performance parameter with the control variable for predicting an optimized setpoint of the control variable for operating the sailboat based on previously acquired data.

4. The system of claim 3, wherein the artificial intelligence system comprises a neural network system, a fuzzy logic system, a genetic algorithm system or an expert system.

5. The system of claim 1, wherein the system comprises:

multiple sailboat performance sensors for acquiring data indicative of multiple performance parameters of the sailboat;

multiple control variable sensors for acquiring data indicative of multiple control variables of the sailboat;

multiple external factor sensors for acquiring data indicative of multiple external factors of the sailboat;

and wherein the correlating means correlates the performance parameters with the control variables and the external factors for determining an optimized setpoint for at least one of the control variables for operating the sailboat under conditions indicated by the external factors.

6. The system of claim 1, wherein the system comprises:

multiple sailboat performance sensors for acquiring data indicative of multiple performance parameters of the sailboat;

multiple control variable sensors for acquiring data indicative of multiple control variables of the sailboat;

multiple external factor sensors for acquiring data indicative of multiple external factors of the sailboat;

and wherein the correlating means correlates the performance parameters with the control variables and the external factors for determining an optimized setpoint for each of the control variables for operating the sailboat under conditions indicated by the external factors.

7. The system of claim 1, further comprising at least one dependent variable sensor for acquiring data indicative of a dependent variable of the sailboat, and wherein the correlating means correlates the performance parameter with the dependent variable and the control variable for determining an optimum setpoint target of the dependent variable for operating the sailboat and an optimized setpoint of the control variable for achieving the optimum setpoint target of the dependent variable.

8. The system of claim 7, wherein the dependent variable of the sailboat is chosen from a group of dependent variables consisting of sail pressure distribution, sail shape, boat heel, sail draft depth, maximum sail draft location, angle of attack of sails, angle of attack of boat, angle of attack of rudder, angle of attack of trim tabs, water pressure differential over different portions of the hull, keel, rudder and trim tabs and air pressure differential over different potions of the sails and mast.

9. The system of claim 1, wherein the system comprises:

multiple sailboat performance sensors for acquiring data indicative of multiple performance parameters of the sailboat;

multiple control variable sensors for acquiring data indicative of multiple control variables of the sailboat;

multiple dependent variable sensors for acquiring data indicative of multiple dependent variables of the sailboat;

multiple external factor sensors for acquiring data indicative of multiple external factors of the sailboat;

and wherein the correlating means correlates the performance parameters with the dependent variables, the control variables and the external factors for determining an optimum setpoint target of the dependent variables for operating the sailboat under conditions indicated by the external factors and an optimized setpoint of the control variables for achieving the optimum setpoint target of the dependent variables under conditions indicated by the external factors.

10. The system of claim 1, wherein the performance parameter of the sailboat is chosen from a group of sailboat performance parameters consisting of boat speed, time to reach a specified destination and velocity made good.

11. The system of claim 1, wherein the performance parameter of the sailboat is chosen from a group of crew performance parameters consisting of tacking time, variation in rudder position, time to jibe, time to change sails, deviation from optimized conditions, and time of deviation from optimized conditions.

12. The system of claim 1, wherein the performance parameter of the sailboat is chosen from a group of sailboat comfort parameters consisting of sailboat heel, roll, pitch, and yaw.

13. The system of claim 1, wherein the performance parameter of the sailboat is chosen from a group of sailboat safety parameters consisting of mast strain, boom strain, sail strain, bow strain, hull strain, rudder strain, rudder linkage strain, and rigging strain.

14. The system of claim 1, wherein the external factor of the sailboat is chosen from a group of external factors consisting of wind speed, wind direction, variations in wind speed, variations in wind direction, sea state, and wave conditions.

15. The system of claim 1, wherein the control variable of the sailboat is chosen from a group of control variables consisting of forestay sag, mast bend, sheet tension, halyard tension, backstay tension, sheeting angle, rudder angle, mast twist, traveller position, jib car position, outhaul tension, guy tension, downhaul tension, topping lift tension, spinnaker pole position, and sail plan.

16. The system of claim 1, wherein the system comprises at least one sail shape sensor for acquiring data indicative of at least one sail shape variable of the sailboat.

17. The system of claim 16, wherein the correlating means correlates the performance parameters with the sail shape variable for determining an optimized setpoint for at least one of the control variables for operating the sailboat.

18. The system of claim 1, further comprising means for calculating at least one indirect variable of the sailboat that is not directly measurable.

19. The system of claim 18, wherein the indirect variable of the sailboat is chosen from a group of indirect variables consisting of true wind direction, true wind speed, sea state, boat leeway, true boat heading, true boat speed, passenger comfort level, boat safety factor, angle of attack of sails, angle of attack of boat, angle of attack of rudder, and angle of attack of trim tabs.

20. The system of claim 1, further comprising means for selectively plotting and displaying a first chosen parameter or variable against a second chosen parameter or variable.

21. A system for acquiring and evaluating performance data of a sailboat, the system comprising:

at least one sailboat performance sensor for acquiring data indicative of a performance parameter of the sailboat;

at least one sail shape sensor for acquiring data indicative of at least one sail shape variable of the sailboat;

at least one external factor sensor for acquiring data indicative of an external factor of the sailboat; and correlating means for correlating the performance parameter with the sail shape variable at a given external factor level.

22. The system of claim 21, further comprising:

at least one control variable sensor for acquiring data indicative of a control variable affecting sail shape;

and wherein the correlating means correlates the performance parameter with the control variable and the sail shape variable for determining an optimized setpoint of the control variable for operating the sailboat.

23. The system of claim 1, further comprising:

adaptive feedback control means for operating a control input of the sailboat associated with the control variable.

* * * * *